United States Patent [19]

Larson et al.

[11] Patent Number: 4,969,158

[45] Date of Patent: Nov. 6, 1990

[54] INDUCTIVE HEATING UNIT

[75] Inventors: Hans-Gunnar Larson; Gote Tallback; Bjorn Widell, all of Västeras, Sweden

[73] Assignee: ASEA Brown Boveri, Västeras, Sweden

[21] Appl. No.: 419,281

[22] Filed: Oct. 10, 1989

Related U.S. Application Data

[63] Continuation of Ser. No. 13,667, Feb. 12, 1987.

[30] Foreign Application Priority Data

Feb. 12, 1986 [SE] Sweden ..... 8600616

[51] Int. Cl.[5] ..... H05B 6/24

[52] U.S. Cl. ..... 373/152; 373/153

[58] Field of Search ..... 373/151–154, 373/155, 156, 158

[56] References Cited

U.S. PATENT DOCUMENTS

| | | | |
|---|---|---|---|
| 1,330,133 | 2/1920 | Northrup | 373/152 |
| 1,721,073 | 7/1929 | Esmarch | 373/152 |
| 1,748,706 | 2/1930 | Esmarch | 373/152 |
| 1,775,351 | 9/1930 | Linnhoff | 373/151 |
| 1,872,990 | 8/1932 | Linnhoff | 373/152 |
| 3,303,259 | 2/1967 | Junker | 373/151 |
| 3,935,412 | 1/1976 | McDonough et al. | 373/154 |

*Primary Examiner*—Roy N. Envall, Jr.
*Attorney, Agent, or Firm*—Kenyon & Kenyon

[57] ABSTRACT

An inductive heating unit for a magnetically permeable ladle containing molten steel has a cylindrical permeable wall for receiving the ladle and on which is wound an induction coil with an outer cylindrical permeable wall surrounding and enclosing the coil. The coil is wound from a conductor formed by a plurality of superposed flat metal strips which are insulated from each other. The outer wall is formed with a vertical channel in which a power lead for the coil is positioned.

2 Claims, 5 Drawing Sheets

PRIOR ART

INDUCTIVE HEATING UNIT

This is a Continuation of application Ser. No. 013,667 filed February 12, 1987 now abandoned.

This invention relates to an inductive heating unit for a ladle containing for example, molten steel and which has a magnetically permeable side wall but which otherwise has the cylindrical contour of a steel ladle.

The unit is cylindrical and the ladle can be lowered into and upwardly removed from the unit. The unit is stationary and includes an induction heating coil for inductively heating the molten steel in the ladle.

An example of the above is provided by the Larsson et al U.S. Pat. No. 4,618,964. A problem with such a heating unit has been the high electrical losses involved from its coil having been formed by a hollow solid-walled conductor for water cooling. The conductor is made of copper but the copper area is not used efficiently.

Briefly summarized the unit of the present invention uses an induction heating coil formed by a conductor of the Roebel or sheet wound type made from multiple layers of sheet-like copper strips which are superposed and electrically insulated from each other throughout the length of the conductor. This conductor is formed into the coil with the conductor's flat-sides facing radially. This coil is enclosed by inner and outer cylindrical walls of magnetically permeable material forming a cylindrically shape for loosely receiving the ladle. The inner wall is made thick enough to provide structural strength on which the coil can be wound and the outer wall may be formed to conform with the shape of the coil and its power supply leads. The walls are interpaced so that fluid coolant can be flowed between them. Other details will become apparent from the following.

The accompanying drawings illustrate an example of this new unit, the various views being as follows:

FIG. 1 is a vertical sectional view;

FIG. 1*a* is a vertical section showing the coil form;

FIG. 1*b* is a perspective view of a part of a Roebel type conductor with its flat elements partly peeled away;

Figure 4:
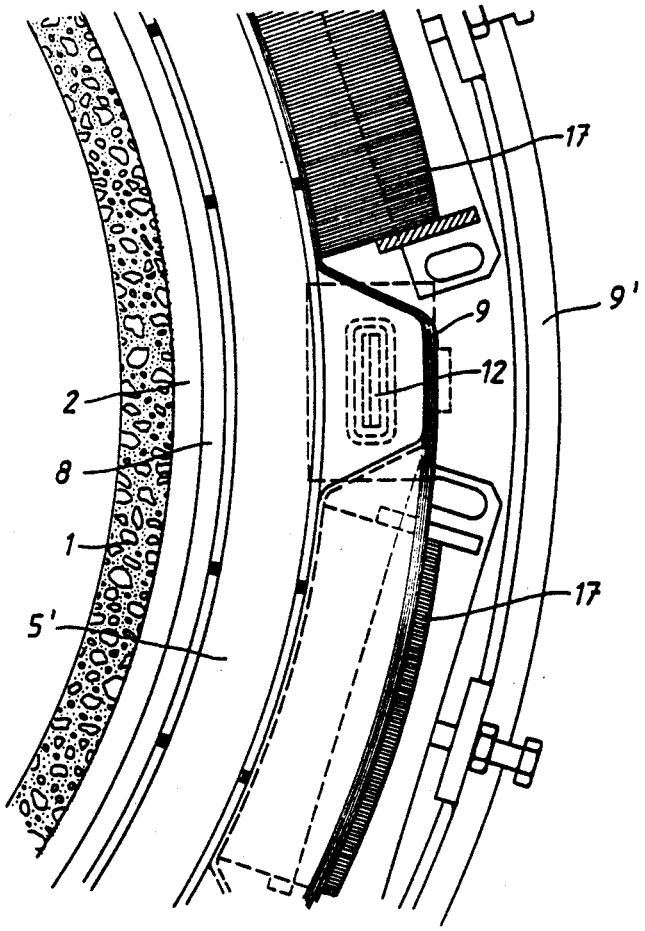
FIG. 4 is like FIG. 2 but shows a modification.
Figure 4A:
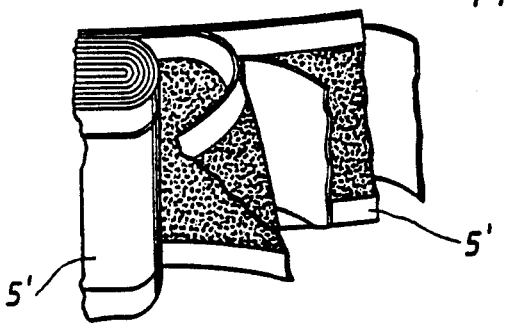

FIG. 4*a* is a perspective view of a sheet wound conductor with its flat elements partially peeled away.

Having reference to the drawings, the cylindrical ladle comprises a lining 1, a reinforced wall portion 2 and upper and lower steel collars 3A and 3B. The ladle contains a molten steel melt 4. The wall of the ladle is magnetically permeable and may be made as shown by the Laarson et al U. S. Pat. No. 4,618,964. Although not shown, the ladle may have trunnions so that it can be carried by a crane.

Referring now to the new inductive heating unit its inductive heating coil 5 and the cylindrical unit itself form an annular space 6 when the ladle is lowered into the unit. The unit is stationary and unconnected with the ladle, the latter being free to be lowered into and raised from the unit.

The coil 5 is enclosed between two concentric cylinders, forming an inner wall 8 and an outer wall 9. These cylindrical walls are magnetically permeable as for instance being formed by glass fiber reinforced plastic. The inner wall 8 is radially spaced from the wall of the ladle when the latter is placed in the unit. In the area 13, between the two cylindrical walls, which are radially interspaced, fluid coolant may be passed to cool the coil 5, by suitable fluid connections (not shown).

Figure 3:
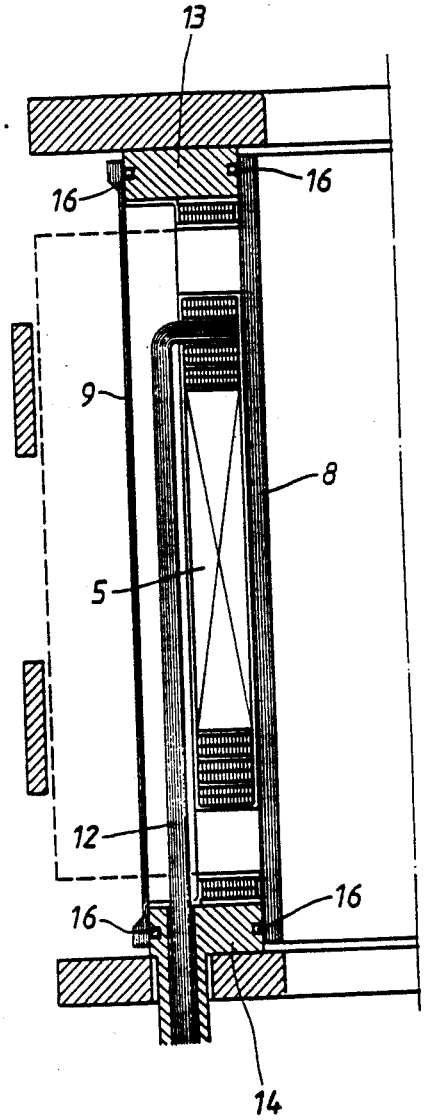
FIG. 3 is a vertical sectional view taken on the line III—III in FIG. 2.

The inner cylinder or wall is entirely cylindrical throughout it axial extent and is made thick enough to have the strength sufficient for the coil to be formed on it. The outer cylinder or wall 9 may be of less thickness than the wall 8 and is generally cylindrical excepting for having axially extending, inward recesses adapted to the shape of an iron core 11 and radially outwardly extending vertical channels providing clearance for the power supply leads 12 for the coil 5. The ends of the two cylindrical walls are closed by upper and lower rings 13 and 14 provided with seals 16 as shown in FIG. 3. The coil 5 can be axially compressed between these rings and within the rings short-circuited winding turns or coils may be positioned for limiting the field of the coil 5. These turns, or small coils 15 are also formed from the Roebel or sheet wound type conductors and they are positioned in the common space formed between the two walls 8 and 9.

Figure 1:
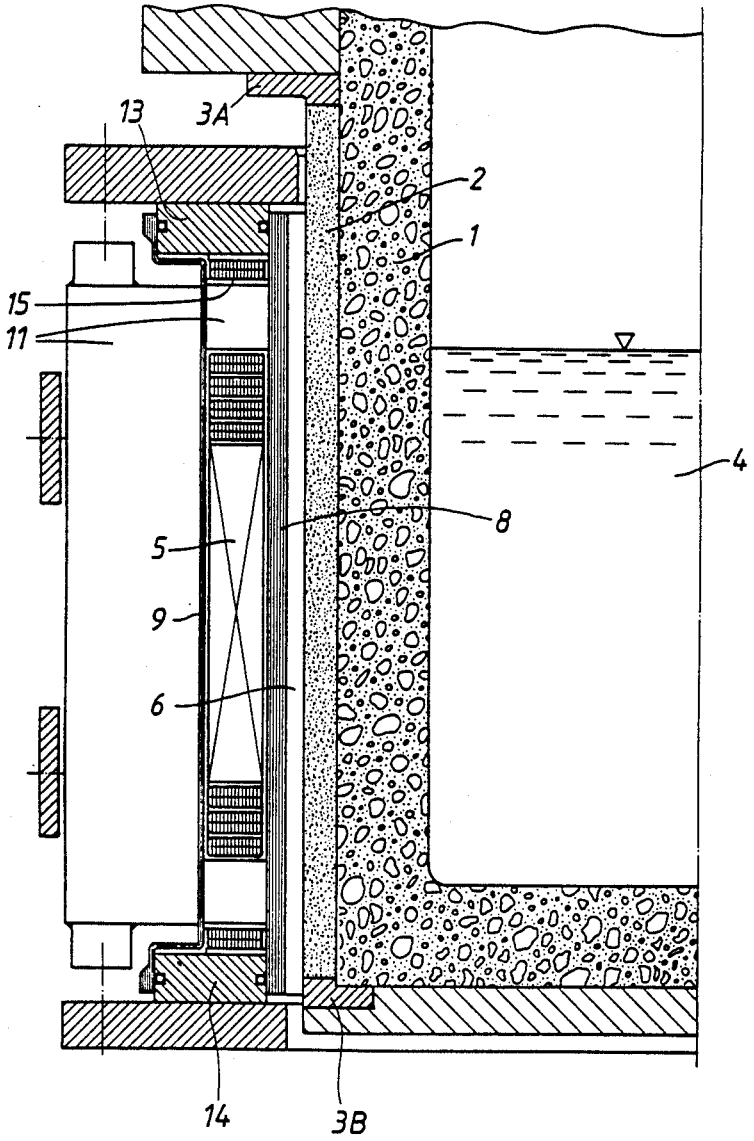
Figure 1A:
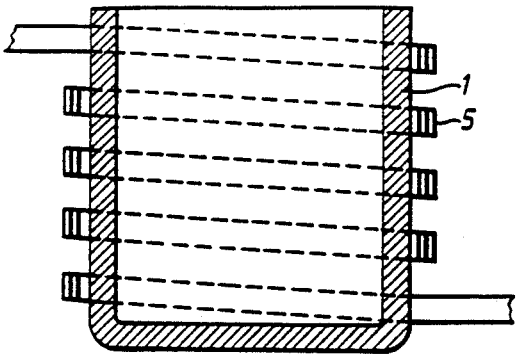
Figure 1B:
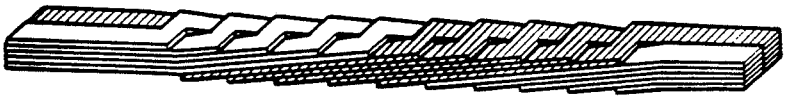
PRIOR ART FIG. 1b
Figure 2:
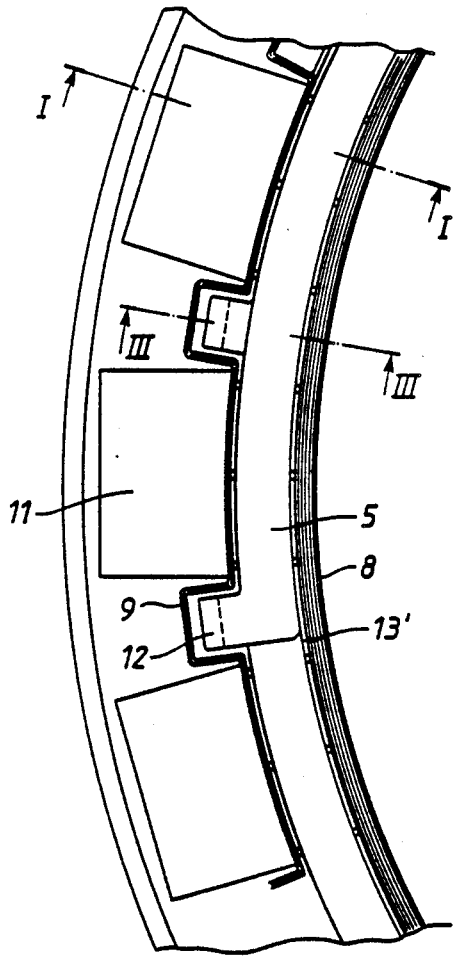
FIG. 2 is a cross-section taken from FIG. 1.

As shown by FIG. 1*a* the coil 5 within the field of which the ladle 1 is placed for heating of the ladle content, is helically formed. However, the coil conductor is of the Roebel type shown by FIG. 1*b* as comprising a plurality of flat copper strips which are superposed on each other and shaped so that they are transposed with respect to each other. This type of conductor has been used in the construction of electrical transformers. A sheet-wound conductor coil is shown by FIG. 4*a*.

It can be seen that the coil sealed between the inner and outer magnetically permeable cylinders or walls form that is in effect a package. The coil must have a height dictated by the height of the molten steel melt in the ladle and the unit and its parts are stationary, supported by any appropriate support. Only the ladle is moveable and it fits loosely in the inner wall of the unit as shown by the radial annular space 6.

We claim:

1. An inductive heating unit for a ladle containing molten metal and having a magnetically permeable side wall, said unit comprising an inner cylindrical wall for receiving the ladle, an induction coil surrounding said inner wall and wound from a conductor comprising a plurality of superposed flat metal strips which are insulated from each other, said conductor having flat sides facing radially, and an outer cylindrical wall radially spaced from the inner wall and surrounding said coil, said walls being made of magnetically permeable material and the inner wall being thicker than the outer wall and said coil being wound on the inner wall, the outer wall being formed with at least one vertical channel and the coil having a power lead extending in the channel, said walls enclosing the coil closely so that said unit is not substantially thicker than the coil, the ends of the walls being closed together.

2. The unit of claim 1 in which at the ends of said coil short-circuited induction coils are positioned inside of the closed ends of said walls.

* * * * *